US010975646B2

(12) United States Patent
Xu et al.

(10) Patent No.: US 10,975,646 B2
(45) Date of Patent: Apr. 13, 2021

(54) OBJECT REMOVAL ENHANCEMENT ARRANGEMENT AND METHOD

(71) Applicants: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(72) Inventors: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 196 days.

(21) Appl. No.: 16/046,837

(22) Filed: Jul. 26, 2018

(65) Prior Publication Data

US 2020/0032606 A1 Jan. 30, 2020

(51) Int. Cl.

| | |
|---|---|
| ***E21B 34/10*** | (2006.01) |
| ***E21B 29/02*** | (2006.01) |
| ***E21B 43/26*** | (2006.01) |

(52) U.S. Cl.

CPC ..... *E21B 29/02* (2013.01); *E21B 34/10* (2013.01); *E21B 43/26* (2013.01)

(58) Field of Classification Search

CPC ..... E21B 29/02; E21B 43/26; E21B 33/12; E21B 34/06; E21B 34/10; B22F 1/02

See application file for complete search history.

(56) References Cited

U.S. PATENT DOCUMENTS

| | | | | |
|---|---|---|---|---|
| 8,573,295 | B2 | 11/2013 | Johnson et al. | |
| 9,079,246 | B2 | 7/2015 | Xu et al. | |
| 9,938,451 | B2 | 4/2018 | Crews | |
| 2013/0043041 | A1* | 2/2013 | McCoy | E21B 34/14 166/373 |
| 2013/0146302 | A1 | 6/2013 | Gaudette et al. | |
| 2013/0192829 | A1 | 8/2013 | Fadul et al. | |
| 2014/0076571 | A1 | 3/2014 | Frazier et al. | |
| 2015/0159462 | A1 | 6/2015 | Cutler | |
| 2016/0273300 | A1 | 9/2016 | Walton et al. | |
| 2016/0312111 | A1* | 10/2016 | Okura | E21B 23/04 |
| 2017/0121596 | A1 | 5/2017 | Canova et al. | |
| 2018/0087369 | A1 | 3/2018 | Sherman et al. | |
| 2020/0032605 | A1 | 1/2020 | Xu et al. | |

FOREIGN PATENT DOCUMENTS

WO 2015073001 A1 5/2015

OTHER PUBLICATIONS

Notification of Transmittal of the International Search Report and the Written Opinion of the International Searching Authority, or the Declaration; PCT/US2019/038381; dated Sep. 30, 2019; ISR 4 pages, WO 7 pages; Total 11 pages.

* cited by examiner

*Primary Examiner* — Yong-Suk (Philip) Ro
(74) *Attorney, Agent, or Firm* — Cantor Colburn LLP

(57) ABSTRACT

An object removal enhancement arrangement including a seat, a volume movable with the seat, the volume being protected in a first condition of the seat and unprotected in a second condition of the seat, and a material disposed within or as a part of the volume, the material degradative of an object.

18 Claims, 3 Drawing Sheets

OBJECT REMOVAL ENHANCEMENT ARRANGEMENT AND METHOD

BACKGROUND

In the resource recovery industry it is often the case that multiple tools are positioned in the downhole environment that are actuated by objects landed on seats to facilitate the imposition of pressure differentials across such seats to make components of the downhole system move. In many such systems of a more contemporary nature, the objects are degradable objects such as for example, objects made from IN-Tallic™ degradable material commercially available from Baker Hughes, a GE company, Houston Tex. One example of a system like this is a fracture and production system where a fracturing operation is undertaken by landing a object on a fracture seat and pressuring up thereon to fracture a zone of the formation. Another object may then be landed on a second seat to close fracture ports and open production ports. Other systems like this example are certainly available in the art. In each of these, circulating fluid does not well reach the first landed object as it is in a relatively dead fluid and debris collecting space of the borehole between the second landed object and the seat upon which the first landed object is seated. The condition just discussed tends to result in a reduced reactivity such that degradable objects fail to degrade at the rate they were designed to degrade thereby inducing delay in whatever operation is being performed. The art would well receive arrangements that improve efficiency.

SUMMARY

An object removal enhancement arrangement including a seat, a volume movable with the seat, the volume being protected in a first condition of the seat and unprotected in a second condition of the seat, and a material disposed within or as a part of the volume, the material degradative of an object.

A resource recovery system including a tubular string disposed in a formation, a seat disposed in the tubular string, a volume moveable with the seat, the volume being protected in a first condition of the seat and unprotected in a second condition of the seat, and a material disposed within or as a part of the volume, the material degradative of an object.

A method for enhancing response time for degrading degradable objects in a system including landing a first object on a first seat, pressuring against the first object, landing a second object on a second seat uphole of the first object, exposing a material moveable with the second seat to an environment between the first seat and the second seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
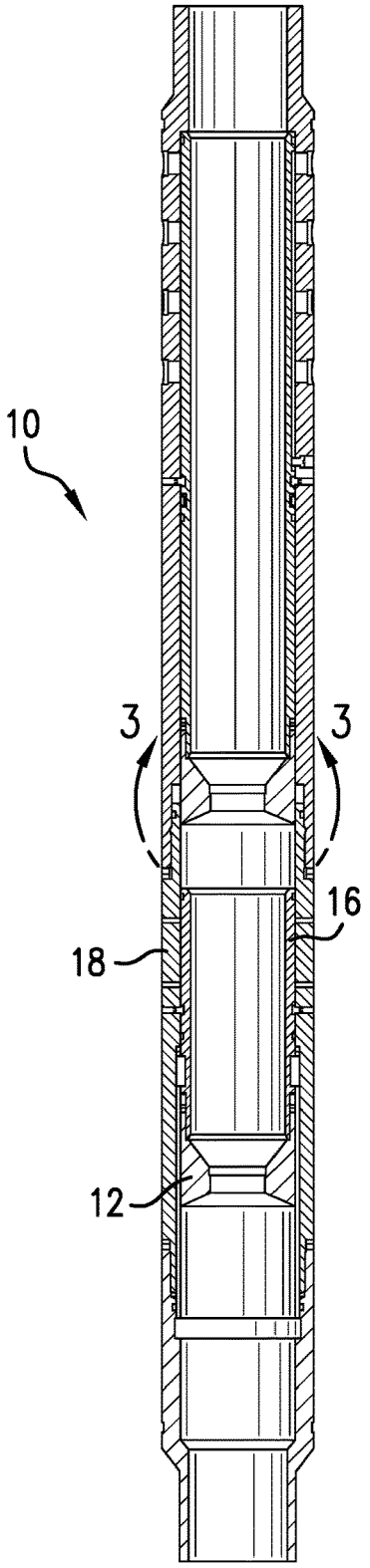
FIGS. 1 and 2 illustrate an exemplary fracture and production system, FIG. 1 being in a position prior to objects being landed and FIG. 2 being in a position after both objects have been landed.
Figure 2:
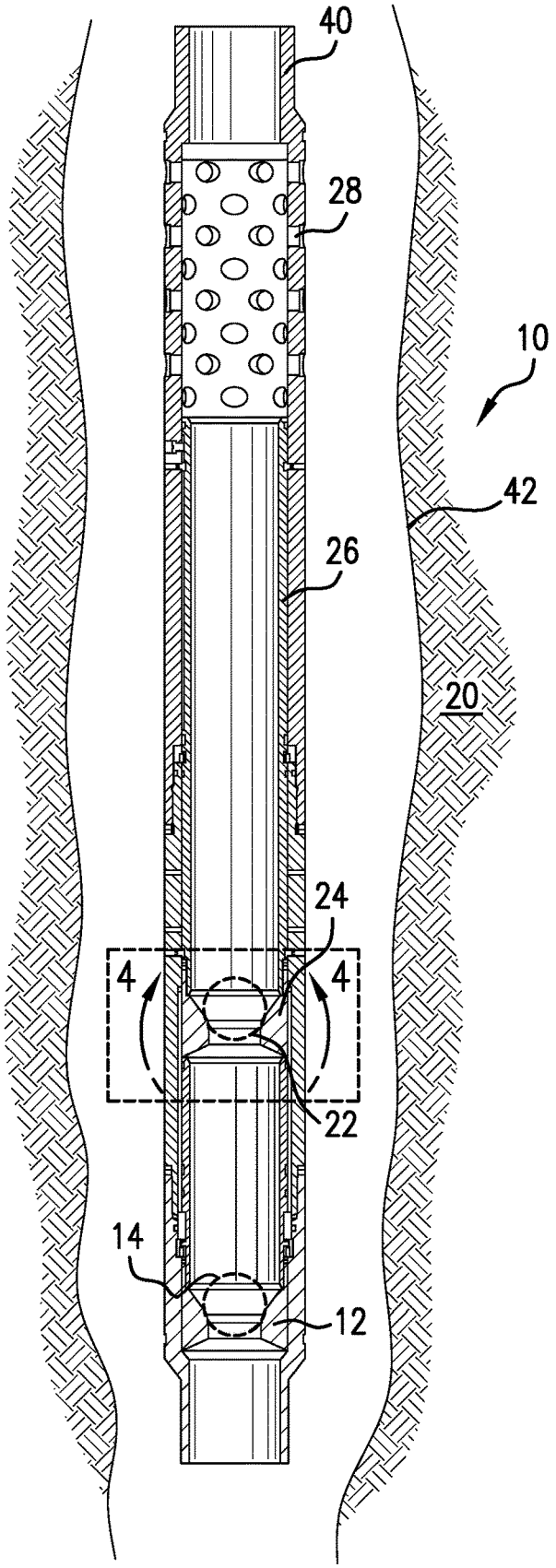

Referring to FIGS. 1 and 2, an exemplary fracture and production system 10 is illustrated in two positions. The first position, shown in FIG. 1, the system 10 is ready for use before any objects are landed therein. During use, a lower seat 12 is employed to catch an object 14 (seen in FIG. 2). Object 14 is intended to hold great pressure related to fracturing a zone of the formation. Because of this, the object itself must have the structural integrity to withstand the forces placed thereon. Greater structural integrity is the antithesis of degradatory components and hence these particular objects present greater difficulty with respect to rapid degradation. Once object 14 is seated in seat 12, pressure may be applied thereto moving seat 12 in a direction to move a sleeve 16, which may be a frac sleeve, to uncover a port 18, which may be a frac port. It will be appreciated that FIGS. 1 and 2 do not show the intermediate position of the frac port 18 open for a fracturing operation but rather jump from the first position where neither of the seats are moved to a production position where both of the seats are moved. The sequence of a first object opening a fracture port and a second object closing the fracture port and opening a production pathway is a known sequence and hence does not require ad nauseum recitation. The object removal enhancement arrangement and method disclosed herein on the other hand is an advancement for the art. To ensure understanding of the object removal enhancement arrangement and method this basic reference to the system is useful. Once the frac port 18 is uncovered by movement of sleeve 16, a pressure up operation against the object 14 will result in fracturing of a formation 20 radially outwardly of the system 10. Once the fracturing is complete, a second object 22 is landed upon an upper seat 24. This allows for pressure differential across seat 24 and thereby movement of seat 24 in the downhole direction. The seat 24 is connected to a closure sleeve 26 that is drawn along in the downhole direction with the seat 24 thereby closing the port 18 and opening a production pathway 28. Each of the objects 14 and 22 would comprise a degradable material and will eventually degrade but such degradation may be enhanced with other features of the system 10.

Figure 3:
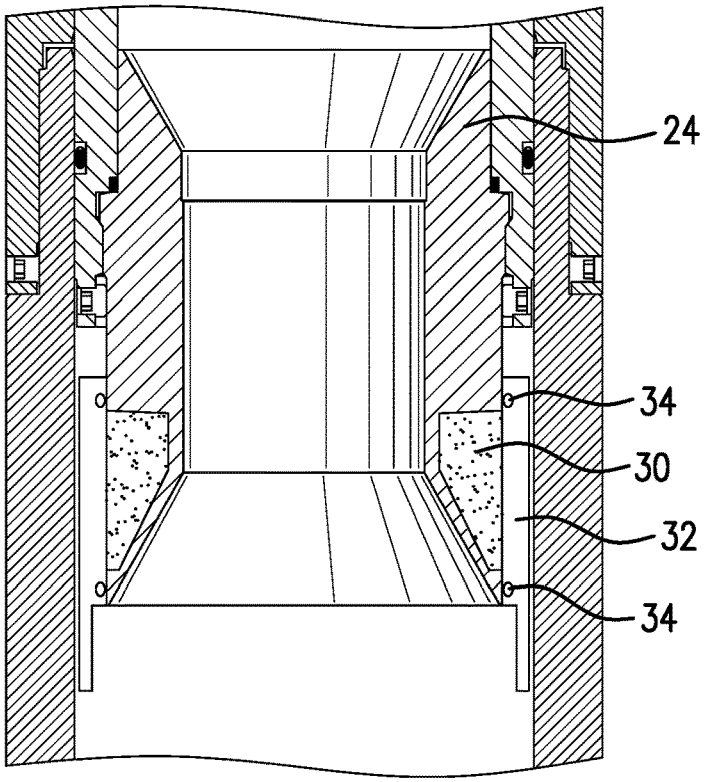
FIG. 3 is an enlarged view of circumscribed area 3-3 in FIG. 1.
Figure 4:
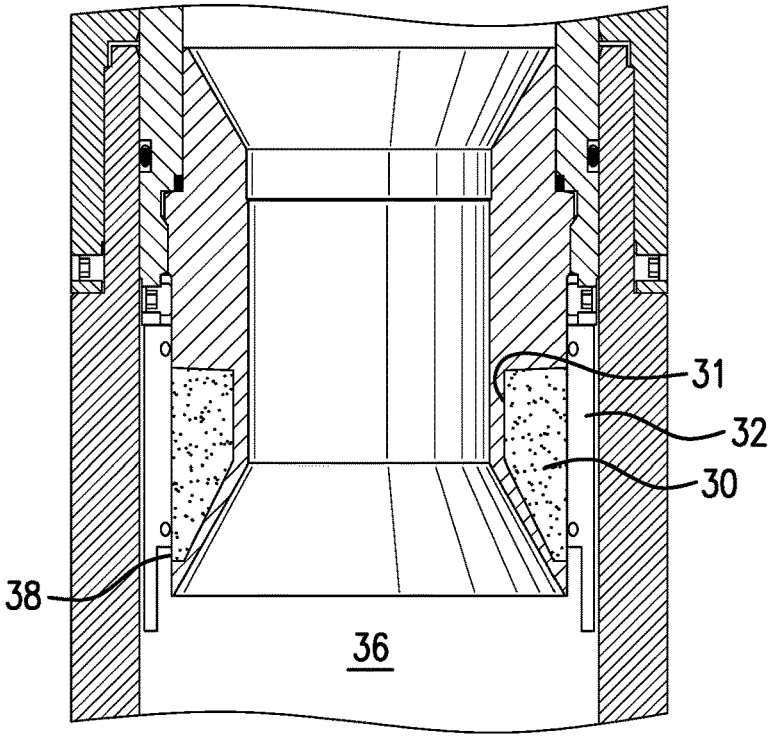
FIG. 4 is an enlarged view of circumscribed area 4-4 in FIG. 2.

Referring to FIGS. 3 and 4, particular structure of system 10 is illustrated providing for plug removal enhancement. It will be appreciated that seat 24 includes a volume 25 as a portion thereof or in a recess 31, which volume 25 comprises or houses therein a material 30. Particularly, the material 30 may be deposited in the recess 31 or the material 30 may actually be a part of the constitution of the seat 24. The material 30 is protected by a closure member 32, which may in embodiments be configured as a sleeve although other protective features such as a coating might be substituted in some instances. In embodiments, the closure member 32 may include seals 34 such as o-ring seals to further segregate the material 30 from surrounding environment. The seat 24 as shown in FIG. 3 is in a condition prior to the object 22 landing thereon. The material 30 will remain isolated until the object 22 lands on the seat 24, urges the seat 24 downhole toward the seat 12 and the closure member contacts the sleeve 16. Upon contacting sleeve 16, the closure member 32 becomes limited in its downhole movement while the seat 24 may still move a short distance downhole. This results in the closure member 32 moving relative to the seat 24 the difference being visible by comparison between FIGS. 3 and 4. In FIG. 4, it will be appreciated that the material 30 is exposed to an environment 36 between seat 24 and seat 12 at exposure area 38. Material 30 will thus migrate into the environment 36 and then settle at object 14. Material 30 as noted above is a degradative material such as acid or other material that will accelerate degradation of object 14. In embodiments, the material may be polyglycolic acid, polylactic acrid, etc. The material 30 after settling about the object 14, will accelerate the degradation thereof thereby rendering the system ready for production more quickly than prior art systems become ready based solely upon the degradatory makeup of the objects 14, 22 themselves.

Figure 5:
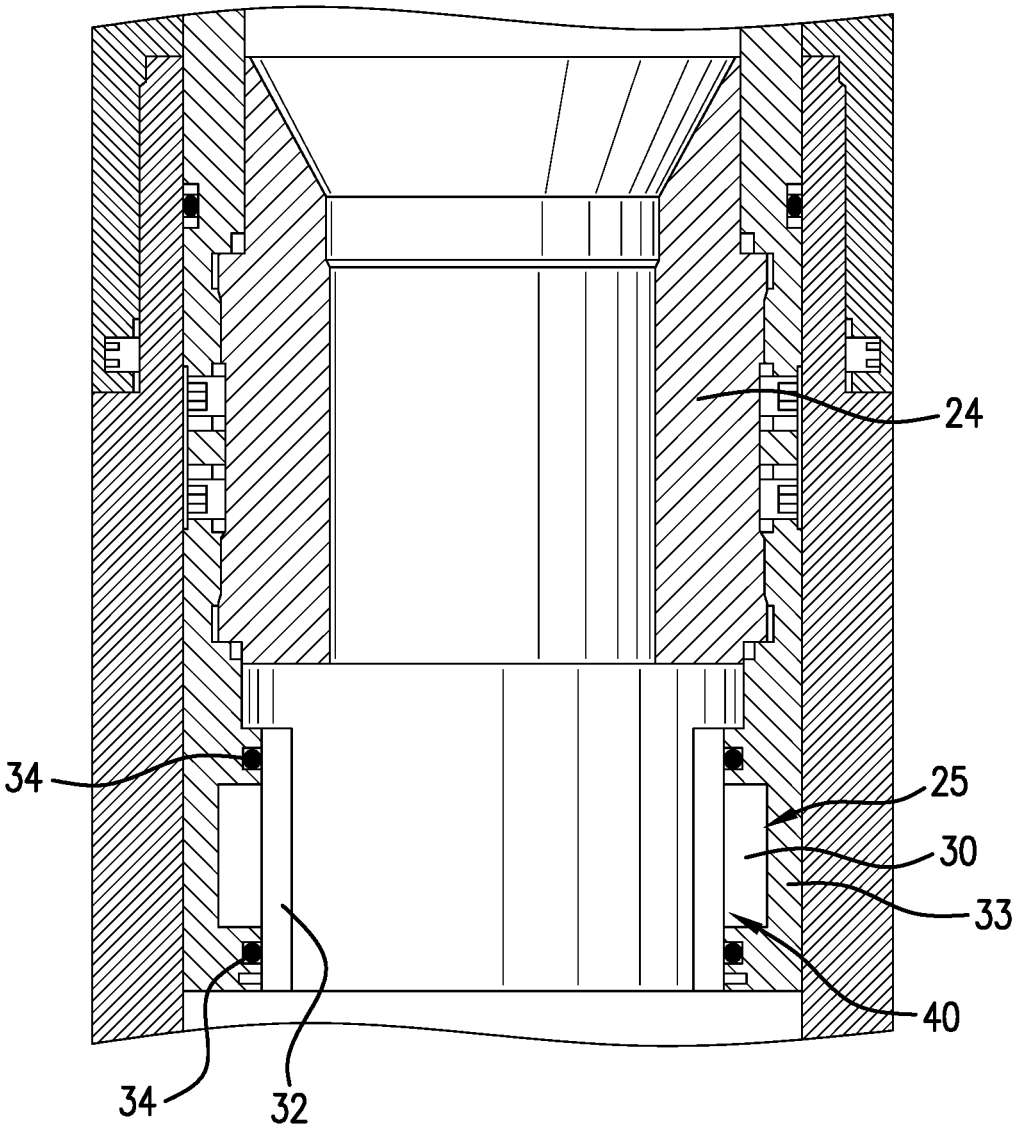
FIG. 5 is a view of an alternate embodiment.

In an alternate embodiment, referring to FIG. 5, the volume 25 is not a part of or disposed in the seat 24 itself but rather is a part of or disposed in another component 33 of system 10 that is connected to the seat 24 in such a way that the component 33 and hence the volume 25 must move with the seat 24. Accordingly, through movement of the seat 24, the volume 25 will necessarily move and through that movement will become exposed to environment 36 through exposure area 40 once closure member 32 moves upwardly in the Figure as it does in FIG. 4.

The system 10 is contemplated to be employed as a part of a tubular string 40 disposed within the formation 20 through a borehole in the formation 20.

A method for enhancing response time for degrading degradable objects in a system 10 including exposing a material 30 to an environment between a first object 14 and a second object 22 or seat 24 and degrading the object 14 and/or seat 12.

Set forth below are some embodiments of the foregoing disclosure:

Embodiment 1: An object removal enhancement arrangement including a seat, a volume movable with the seat, the volume being protected in a first condition of the seat and unprotected in a second condition of the seat, and a material disposed within or as a part of the volume, the material degradative of an object.

Embodiment 2: The arrangement as in any prior embodiment wherein the volume is in a recess in the seat.

Embodiment 3: The arrangement as in any prior embodiment wherein the volume is of a component other than the seat while remaining movable with the seat.

Embodiment 4: The arrangement as in any prior embodiment wherein the volume is protected by a closure member.

Embodiment 5: The arrangement as in any prior embodiment wherein the closure member is a rupture member.

Embodiment 6: The arrangement as in any prior embodiment wherein the closure member includes a seal.

Embodiment 7: The arrangement as in any prior embodiment wherein the closure member is a sleeve.

Embodiment 8: The arrangement as in any prior embodiment wherein the material is an acid.

Embodiment 9: The arrangement as in any prior embodiment wherein the material is polyglycolic acid.

Embodiment 10: The arrangement as in any prior embodiment wherein the material is polylactic acid.

Embodiment 11: A resource recovery system including a tubular string disposed in a formation, a seat disposed in the tubular string, a volume moveable with the seat, the volume being protected in a first condition of the seat and unprotected in a second condition of the seat, and a material disposed within or as a part of the volume, the material degradative of an object.

Embodiment 12: A method for enhancing response time for degrading degradable objects in a system including landing a first object on a first seat, pressuring against the first object, landing a second object on a second seat uphole of the first object, exposing a material moveable with the second seat to an environment between the first seat and the second seat.

Embodiment 13: The method as in any prior embodiment wherein the pressuring against the first object includes fracturing a formation.

Embodiment 14: The method as in any prior embodiment wherein the exposing includes shifting the second seat.

Embodiment 15: The method as in any prior embodiment wherein the exposing includes rupturing a closure member.

Embodiment 16: The method as in any prior embodiment wherein the exposing includes moving a sleeve disposed about the second seat.

Embodiment 17: The method as in any prior embodiment wherein exposing the material includes migrating the material to the first object.

Embodiment 18: The method as in any prior embodiment wherein exposing the material includes degrading the first object.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An object removal enhancement arrangement comprising:

a seat;

a volume movable with the seat, the volume being protected in a first condition of the seat and unprotected in a second condition of the seat; and a material disposed within or as a part of the volume in the first condition and movable with the seat, the material degradative of an object.

2. The arrangement as claimed in claim 1 wherein the volume is in a recess in the seat.

3. The arrangement as claimed in claim 1 wherein the volume is of a component other than the seat while remaining movable with the seat.

4. The arrangement as claimed in claim 1 wherein the volume is protected by a closure member.

5. The arrangement as claimed in claim 4 wherein the closure member is a rupture member.

6. The arrangement as claimed in claim 4 wherein the closure member includes a seal.

7. The arrangement as claimed in claim 4 wherein the closure member is a sleeve.

8. The arrangement as claimed in claim 1 wherein the material is an acid.

9. The arrangement as claimed in claim 1 wherein the material is polyglycolic acid.

10. The arrangement as claimed in claim 1 wherein the material is polylactic acid.

11. A resource recovery system comprising:

a tubular string disposed in a formation;

a seat disposed in the tubular string;

a volume moveable with the seat, the volume being protected in a first condition of the seat and unprotected in a second condition of the seat; and a material disposed within or as a part of the volume in the first condition and movable with the seta, the material degradative of an object.

12. A method for enhancing response time for degrading degradable objects in a system comprising:

landing a first object on a first seat;

pressuring against the first object;

landing a second object on a second seat uphole of the first object;

exposing a material moveable with the second seat to an environment between the first seat and the second seat, the material being degradative to an object.

13. The method as claimed in claim 12 wherein the pressuring against the first object includes fracturing a formation.

14. The method as claimed in claim 12 wherein the exposing includes shifting the second seat.

15. The method as claimed in claim 12 wherein the exposing includes rupturing a closure member.

16. The method as claimed in claim 12 wherein the exposing includes moving a sleeve disposed about the second seat.

17. The method as claimed in claim 12 wherein exposing the material includes migrating the material to the first object.

18. The method as claimed in claim 12 wherein exposing the material includes degrading the first object.

* * * * *